US006299481B1

(12) United States Patent
Doi

(10) Patent No.: US 6,299,481 B1
(45) Date of Patent: Oct. 9, 2001

(54) SHIELDED CONNECTOR

(75) Inventor: Etsuro Doi, Tokyo (JP)

(73) Assignee: Kel Corporation, Tokyo (JP)

( * ) Notice: Subject to any disclaimer, the term of this patent is extended or adjusted under 35 U.S.C. 154(b) by 0 days.

(21) Appl. No.: 09/638,157

(22) Filed: Aug. 14, 2000

(30) Foreign Application Priority Data

Aug. 19, 1999 (JP) ..... 11-233216

(51) Int. Cl.[7] ..... H01R 13/648
(52) U.S. Cl. ..... 439/607
(58) Field of Search ..... 439/79, 607–610

(56) References Cited

U.S. PATENT DOCUMENTS 6,074,251 * 6/2000 Edgerly et al. ..... 439/610
6,129,586 * 10/2000 Bellemon ..... 439/607

* cited by examiner

*Primary Examiner*—Khiem Nguyen
(74) *Attorney, Agent, or Firm*—Robert W. J. Usher

(57) ABSTRACT

A shielded connector comprises a plurality of female contacts 20 and a shield cover 30. The female contacts 20 are aligned and retained in a row extending in a right and left direction in an insulative housing 10, and said shield cover 30 is mounted on the insulative housing 10. A plurality of insertion openings 11*a* are provided at the front of the insulative housing 10, and the male contacts of a matable connector being inserted through the insertion openings 11*a* into the shielded connector are engaged with the female contacts 20. The shield cover 30 is formed of an electrically conductive plate and bent in a "U" figure, and it is provided with a plurality of through holes 36. When the shield cover 30 is mounted on the insulative housing 10, covering the upper and lower surfaces and the front surface thereof, the through holes 36 of the shield cover 30 meet the insertion opening 11*a* of the insulative housing 10.

6 Claims, 7 Drawing Sheets

SHIELDED CONNECTOR

RELATED APPLICATION

This application claims the priority of Japanese Patent Application No.11-233216 filed on Aug. 19, 1999, which is incorporated herein by reference.

FIELD OF THE INVENTION

The present invention relates to a shielded connector which comprises a plurality of electrical contacts which are aligned in a row in an electrically insulative housing and an electrically conductive shield member which covers the insulative housing.

BACKGROUND OF THE INVENTION

Such shielded connectors have been known. An example of shielded connector is shown in FIG. 12. This shielded connector 90 includes an electrically insulative housing 91, upper and lower shield members 92*a* and 92*b* and a plurality of electrical cables 95. The insulative housing 91 retains a plurality of female contacts (not shown), and the cables 95 are connected to these contacts, respectively, in the insulative housing 91, each cable extending outward. The upper and lower shield members 92*a* and 92*b* cover the upper and lower surfaces and the lateral surfaces of the insulative housing 91. Furthermore, the insulative housing 91 includes a plurality of contact insertion slots 91*a* at the front surface thereof, into which slots the male contacts of a matable connector are inserted for electrical connection with the female contacts in the insulative housing 91. The upper and lower shield members 92*a* and 92*b*, which cover the outer surfaces of the insulative housing 91, function to prevent the signals being transmitted through the contacts from generating any electrical noise outward or any outside noise from entering the shielded connector and affecting the signals being transmitted. Therefore, generally, the upper and lower shield members are electrically grounded.

In this shield connector, the upper and lower shield members 92*a* and 92*b* are formed in complex configurations, such that the shield members are mountable fittingly onto the insulative housing 91, covering the upper and lower surfaces and the lateral surfaces thereof. For example, the shield members are formed in two pieces in configurations to fit and cover the exterior of the insulative housing tightly as shown in FIG. 12. As the two shield members are to fit and engage securely over the insulative housing, these members are provided with complex features. This design for the shield members is disadvantageous as far as the productivity and the cost of the connector are concerned.

There is another possible option for providing an electrical connector with a shield member. A metal plate as the shield member can be wound around the insulative housing of the connector. In this case, the metal plate must be bent and placed over the insulative housing during the assembly of the connector (i.e., the shield member is not prefabricated in a predetermined figure). However, this way of providing the shield member is laborious and can increase the production cost. In addition, it presents another problem that the exterior dimensions of the shielded connector are enlarged by the provision of the shield member, which is added to cover the insulative housing of the connector.

SUMMARY OF THE INVENTION

It is an object of the present invention to provide a shielded connector whose shield member can be produced easily and can be mounted on an insulative housing easily and compactly.

To achieve this objective, a shielded connector according to the present invention comprises a plurality of contacts and a shield member. The contacts are aligned and retained in a row extending in a right and left direction in an electrically insulative housing, and the shield member is mounted over the exterior of the insulative housing. When the shielded connector is engaged with a matable connector, the contacts of the shielded connector come into contact with corresponding contacts of the matable connector at the front of the insulative housing. The above mentioned shield member is formed of an electrically conductive plate and bent in a "U" figure, and it is mounted on the insulative housing and covers the upper and lower surfaces and the front surface of the insulative housing. In addition, the shield member is provided with a plurality of through holes at a front thereof, which meets the front surface of the insulative housing when the shield member is mounted on the insulative housing, such that the contacts of the shielded connector are engaged with the corresponding contacts of the matable connector through these through holes.

An embodiment of shielded connector according to the present invention comprises a plurality of female contacts, which are aligned and retained in a row extending in a right and left direction in an insulative housing, and a shield member (for example, the shield cover 30 of an embodiment described in the following section) is mounted on the insulative housing, covering the exterior thereof. The insulative housing is provided with a plurality of contact insertion slots at the front thereof, such that the male contacts of a matable connector are inserted into the contact insertion slots for engagement with the female contacts of the shielded connector. As the shield member is formed of an electrically conductive plate with a plurality of through holes and bent in a "U" figure to cover the upper and lower surfaces and the front surface of the insulative housing, the through holes of the shield member meet the contact insertion slots of the insulative housing at the front of the insulative housing when the shield member is mounted on the insulative housing.

In this shielded connector, as the shield member is formed of an electrically conductive plate and bent in a "U" figure, the construction of the shield member is relatively simple and can be produced in a cost-effective manner. Also, because the shield member covers only the upper and lower surfaces and the front surface of the insulative housing and leaves the lateral sides of the insulative housing exposed, this design of the connector is compact with a relatively small width dimension. If the lateral sides of the insulative housing were covered as in a prior-art connector, then the width of the connector would be larger. Furthermore, because the shield member covers the front of the insulative housing and has the through holes to let the male contacts of a matable connector pass through for the engagement with the female contacts of the shielded connector, each pair of female and male contacts in engagement is shielded electrically to prevent crosstalk among the contacts.

Another embodiment of shielded connector according to the present invention comprises a plurality of male contacts, which are aligned and retained in a row extending in a right and left direction in an insulative housing, and a shield member (for example, the shield cover 65 of another embodiment described in the following section) is mounted on the insulative housing to cover the exterior thereof. In this case, the male contacts extrude forward at the front of the insulative housing, such that when the shielded connector is engaged with a matable connector, the male contacts enter the female contacts of the matable connector for electrical connection. As the shield member is formed of an electrically conductive plate with a plurality of through holes and bent in a "U" figure and mounted on the insulative housing, covering the upper and lower surfaces and the front surface of the insulative housing, the through holes of the shield member are positioned where the male contacts extrude from the insulative housing at the front thereof, letting the male contacts pass through.

Also, in this shielded connector, as the shield member is formed of an electrically conductive plate and bent in a "U" figure, the design of the shield member is relatively simple and can be produced in a cost-effective manner. In addition, because the shield member covers only the upper and lower surfaces and the front surface of the insulative housing and leaves the lateral sides of the insulative housing exposed, the connector is compact with a width dimension smaller than otherwise as mentioned above. Furthermore, because the shield member covers the front of the insulative housing but let the male contacts pass through by the through holes. When the shielded connector is engaged with a matable connector, each pair of female and male contacts in engagement is shielded electrically by the shield member. As a result, crosstalk among the contacts is prevented effectively.

It is preferable that the shield member be mounted onto the insulative housing in the following manner. At first, the opening of a "U" cross section of the shield member, which is formed of an electrically conductive plate and bent in a "U" figure, is faced to the front of the insulative housing, and then the shield member is moved and pushed to cover the insulative housing from the front rearward. In this way, i.e., just by pushing the shield member to cover the front and then the upper and lower surfaces of the insulative housing, the shield member can be mounted on the insulative housing relatively easily.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DESCRIPTION OF THE PREFERRED EMBODIMENTS

Figure 1:
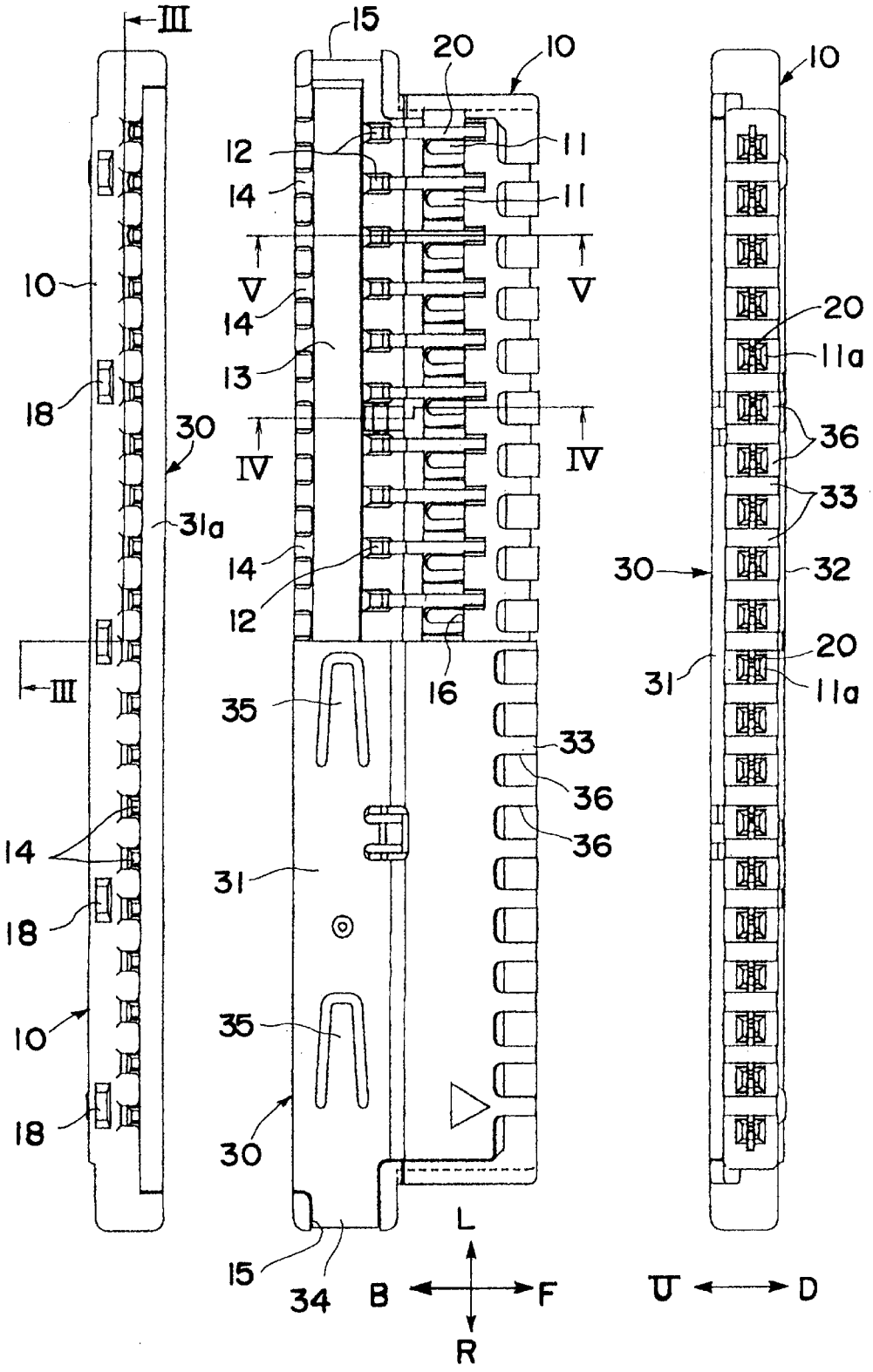
FIG. 1A.
FIG. 1B and FIG. 1C, respectively, show a rear view, a plan view and a front view of a shielded connector according to the present invention.
Figure 2:
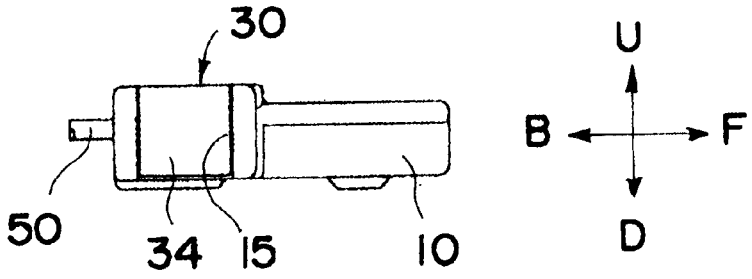
FIG. 2 is a side view of the shielded connector.

FIGS. 1 and 2 show an embodiment of shielded connector according to the present invention. This shielded connector comprises a plurality of female contacts 20, a housing 10 made of an electrically insulative material, and a shield cover 30. The female contacts 20 are aligned in a row in the direction of the width of the shielded connector (the vertical direction of the drawing in FIG. 1), and the shield cover 30 is provided to cover the insulative housing 10. For ease of description, the right side of the drawing shown in FIG. 1B is referred to as the front side of the shielded connector while the left side of the drawing is referred to as the rear side of the connector. Likewise, the upper side of the drawing shown in FIG. 1B is referred to as the left side of the shielded connector while the lower side of the drawing is referred to as the right side of the connector. Furthermore, the right side of the drawing shown in FIG. 1C is referred to as the lower side of the shielded connector while the left side of the drawing is referred to as the upper side of the connector.

To show the internal configuration of the housing 10, the left half of the shield cover 30 is taken away in FIG. 1B though the shield cover 30 covers the insulative housing 10 all the way from the right end of the shielded connector to the left end. For the same purpose, FIG. 1 shows no coaxial cable though the shielded connector comprises an assembly of coaxial cables 50 as described below.

Figure 3:
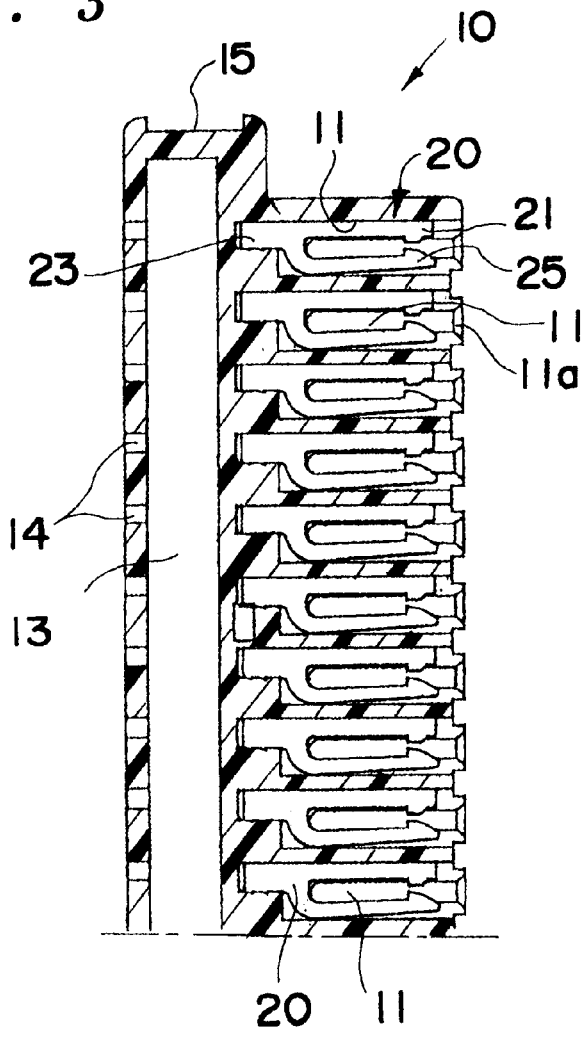
FIG. 3 is a sectional view of the shielded connector, taken along line III-III in FIG. 1A.
Figure 10:
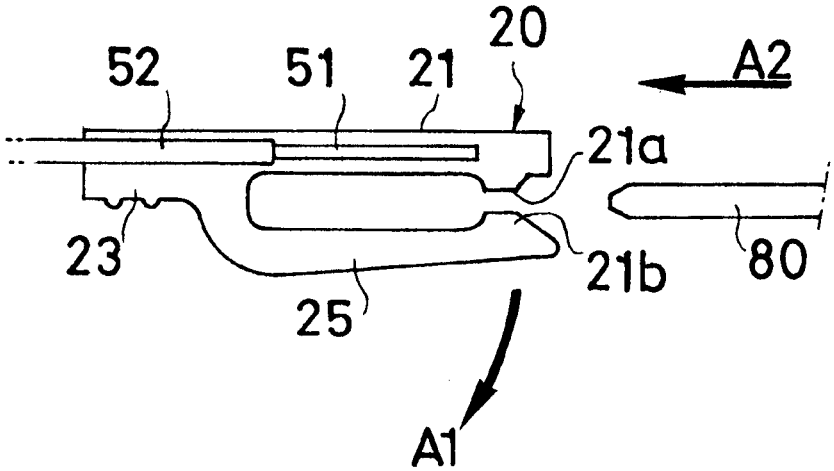
FIG. 10 is a plan view showing a female contact, which is a component of the sheilded connector, and a male contact, which is being engaged with this female contact.

As shown in FIG. 3, which is a sectional view taken along line III—III in FIG. 1A, the insulative housing 10 includes a plurality of contact insertion slots 11, which are aligned in the direction of the width of the shielded connector. Each contact insertion slot 11 has an insertion opening 11*a* which opens forward and through which a corresponding female contact 20 is fitted into and retained in the contact insertion slot 11. As shown in FIG. 3 and FIG. 10, each female contact 20 is formed of a metal plate into an approximate "Y" figure including a base portion 21, a press-fit portion 23 and a resilient arm portion 25. Thus, the female contact 20 looks like a tuning fork as a whole with the base portion 21 and the resilient arm portion 25 of the female contact 20 corresponding to the lateral prongs of a tuning fork and the press-fit portion 23 corresponding to the fixed portion of the tuning fork, respectively.

When the female contacts 20 are inserted through the insertion openings 11*a* and into the contact insertion slots 11 of the insulative housing 10, the base portions 21 and the press-fit portions 23 of the female contacts 20 are press-fit and fixed at the corresponding positions in the insulative housing 10 while the resilient arm portions 25 extend in the contact insertion slots 11 without restriction. Therefore, each resilient arm portion 25 can be deformed elastically in a corresponding contact insertion slot 11 in the direction indicated by arrow A1 in FIG. 10. It should be noted that the female contacts 20 are oriented horizontally on a plane one after another in the insulative housing 10 such that the plane of each female contact 20 extends in the direction of the width of the shielded connector (this direction is hereinafter referred to as "width direction") while the thickness of each female contact 20 is in the direction of the height of the shielded connector as shown in FIG. 3.

Figure 4:
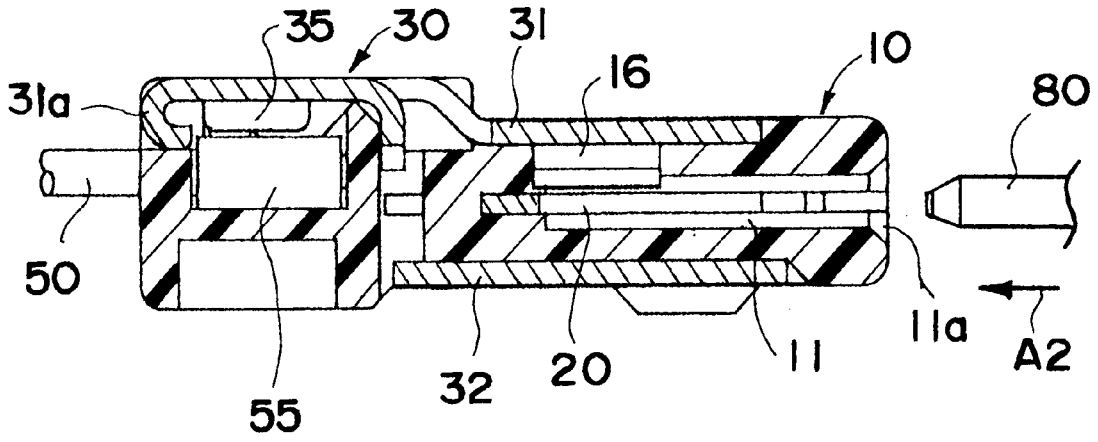
FIG. 4 is a sectional view of the shielded connector, taken along line IV-IV in FIG. 1B.
Figure 5:
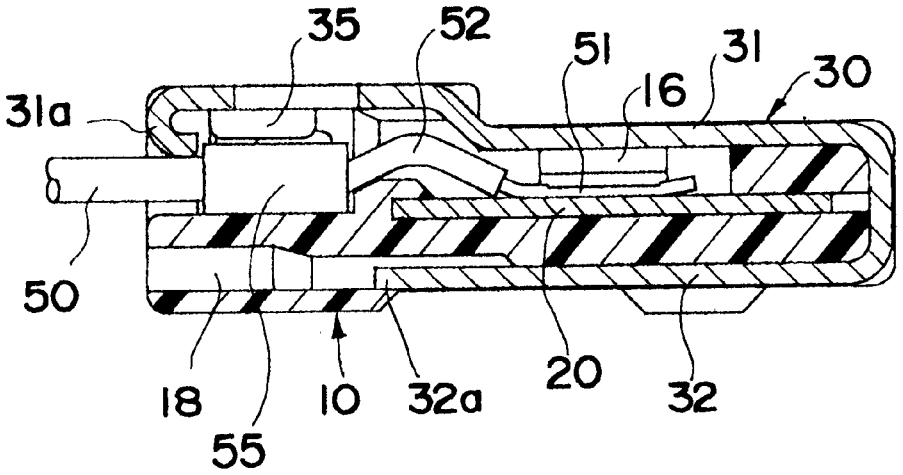
FIG. 5 is a sectional view of the shielded connector, taken along line V-V in FIG. 1B.

In the insulative housing 10, the contact insertion slots 11 are open at the upper rear parts thereof, and a front central groove 16 is provided extending in the width direction at the rear side openings of the contact insertion slots 11 (refer to FIGS. 4 and 5). Also, behind the openings of the contact insertion slots 11 at the positions which corresponds to the base portions 21 of the female contacts 20 in the direction of the front and rear of the shielded connector (hereinafter referred to as "axial direction"), a plurality of front cable support recesses 12 are provided aligned in the width direction and opening upward. Furthermore, behind these recesses 12, a rear central groove 13 is provided extending in the width direction and opening upward, and behind the rear central groove 13 at the positions which correspond to the front cable support recesses 12 in the axial direction, a plurality of rear cable support recesses 14 are provided aligned in the width direction and opening upward. Moreover, the insulative housing 10 is provided with cover fixing grooves 15 at the lateral rear portions thereof and with a plurality of bores 18 which pass through the housing in the axial direction as shown in the figures.

Figure 6A:
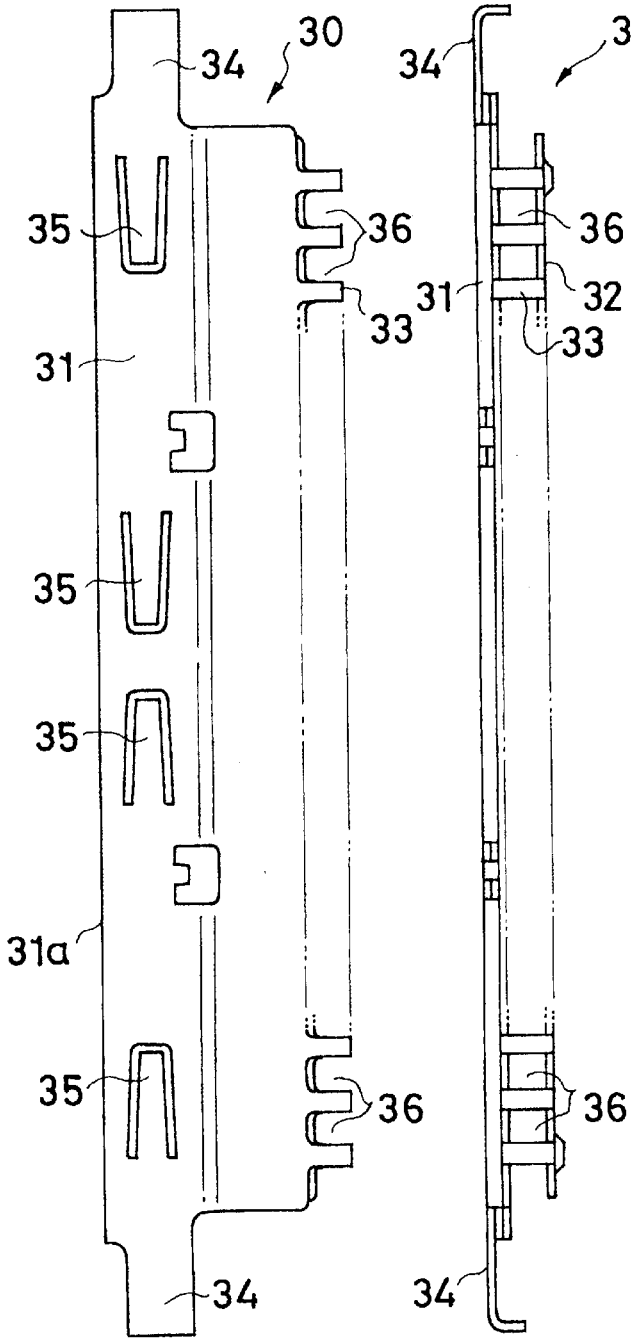
FIG. 6A.
Figure 6B:
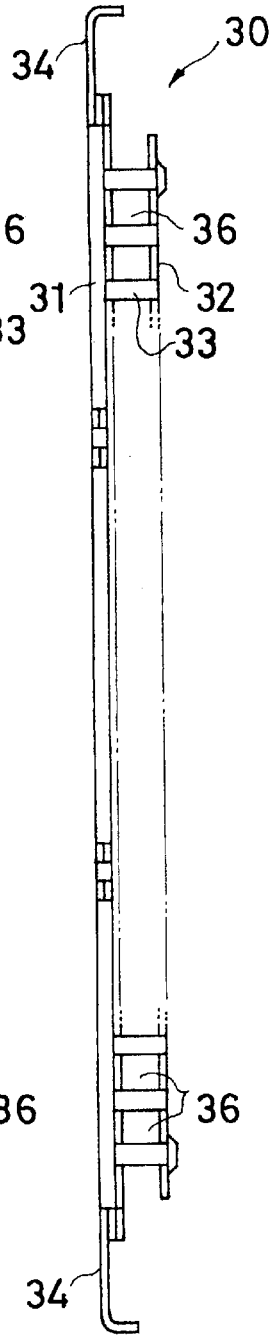
FIG. 6B and FIG. 6C, respectively, show a plan view, a front view and a side view of a shield cover, which is a component of the shielded connector.
Figure 6C:
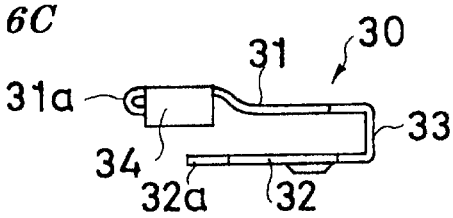

FIG. 6 shows the shield cover 30, which is to be mounted on the insulative housing 10. The shield cover 30 is formed of a metal plate and bent in a "U" figure as shown in FIG. 6C, and it comprises an upper covering surface 31, a lower covering surface 32 and a folded portion 33. The folded portion 33 includes a plurality of through holes 36, which are aligned in the width direction. The upper covering surface 31 includes four contact tabs 35, which are formed by incision and bent to slope downward toward the lower covering surface 32, and the right and left ends of the upper covering surface 31 extend laterally forming engaging arm portions 34. Moreover, the rear end of the upper covering surface 31 is folded inward providing a folded portion 31*a*, which improves the rigidity of the shield cover 30.

Figure 7B:
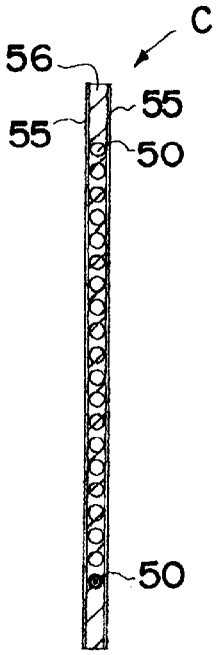
FIG. 7B and FIG. 7C, respectively, show a plan view, a front view and a side view of a cable assembly, which is a component of the shielded connector.
Figure 7A:
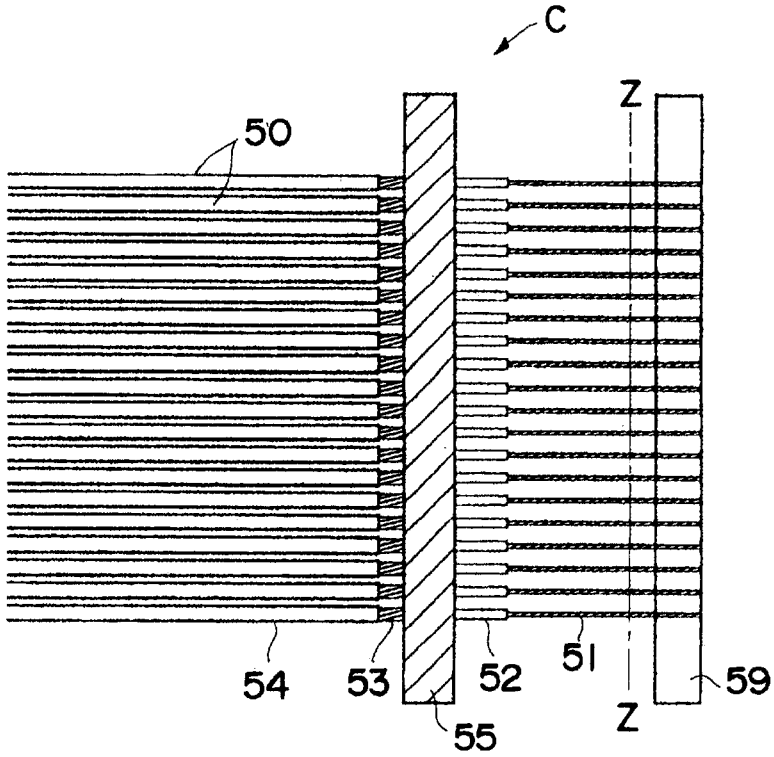
FIG. 7A.
Figure 7C:
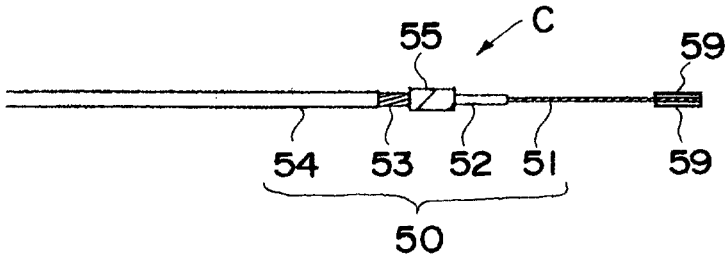

FIG. 7 shows a coaxial cable assembly C, whose coaxial cables are to be connected to the female contacts 20 fixed in the insulative housing 10, respectively. The cable assembly C comprises a plurality of coaxial cables 50, which are aligned on a plane and are sandwiched between a pair of upper and lower binding plates 55 as shown in the figure.

Figure 8A:
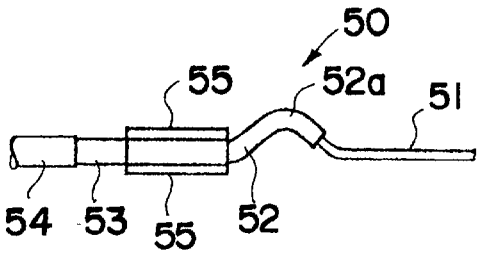
FIG. 8A and FIG. 8B; respectively, show a side view of the cable assembly and an enlarged sectional view of a coaxial cable.
Figure 8B:
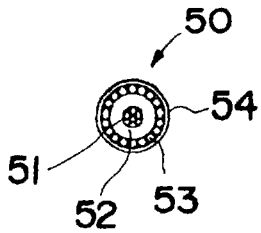

As shown in FIG. 8B, each of the coaxial cables 50 comprises an inner conductor (or core wire) 51, which is positioned centrally, an inner insulating layer 52, which surrounds the core wire 51, a braided outer conductor (or shielding layer) 53, which surrounds the inner insulating layer 52, and an outer insulating layer 54, which covers the shielding layer 53. The cable assembly C is assembled by stripping the respective layers of each coaxial cable 50 in a stair fashion, by aligning the coaxial cables 50 on a plane, by sandwiching the portions of the coaxial cables 50 where the shielding layers 53 are exposed with the binding plates 55 and by soldering them with a solder 56. Furthermore, the core wires 51, which are positioned at the front end of the cable assembly C, are coated with a solder. Moreover, the front ends of the core wires 51 are sandwiched with laminated films 59 to prevent deformation of the core wires 51 for the purpose of maintaining their relative positions intact. Before the cable assembly C is soldered to the plug connector, the front end portions of the core wires 51 are cut away at the position indicated by a chain line Z—Z in FIG. 7A, and the portions where the inner insulating layers 52 are exposed are bent in a U or V shape so that the coaxial cables are provided with slacks 52*a* as shown in FIG. 8A.

Now, in reference to FIGS. 4 and 5, a description is given of the assembly of the shielded connector, whose components are described above. At first, the female contacts 20 are inserted through the insertion openings 11*a* of the insulative housing 10 and into the contact insertion slots 11 thereof. Upon the insertion, the female contacts 20 are aligned and fixed in the insulative housing 10 as described above. In this condition, the base portions 21 and the press-fit portions 23 of the female contacts 20 are fit and fixed at the corresponding positions in the insulative housing 10 while the resilient arm portions 25 can be deformed elastically in the corresponding contact insertion slots 11 in the direction indicated by arrow A1 in FIG. 10.

Figure 9:
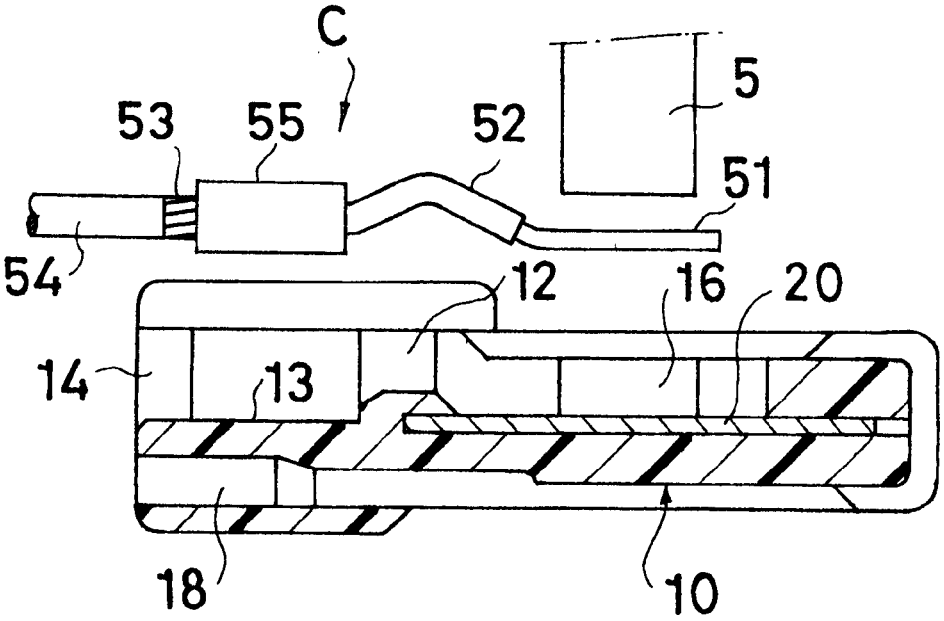
FIG. 9 is a sectional view to describe a process where the cable assembly is mounted in the shielded connector.

On the insulative housing 10 in this condition, the cable assembly C is mounted downward from the above as shown in FIG. 9. In this mounting, the core wires 51 of the coaxial cables 50 are positioned on the base portions 21 of the female contacts 20, the inner insulating layers 52 of the coaxial cables 50 are positioned in the front cable support recesses 12 of the insulative housing 10, the binding plates 55 are positioned in the rear central groove 13 of the housing 10, and the exposed shielding layers 53 and outer insulating layers 54 of the coaxial cables 50 are positioned in the rear cable support recesses 14 of the housing 10 as shown in FIG. 10. Then, the heating chip 5 of a pulse heater is brought into the front central groove 16 of the insulative housing 10, and the heating chip 5 is pressed onto the core wires 51, which are positioned on the base portions 21 of the female contacts 20, to heat all the core wires 51 together. Because the core wires 51 are pre-coated with a solder, when they are heated by the heating chip 5, the solder melts and produces a soldered connection between each core wire 51 and the base portion 21 of a corresponding female contact 20.

Next, the shield cover 30 is mounted on the insulative housing 10. At first, the opening of the shield cover 30, whose cross section is a "U" figure, is oriented to face the front of the housing 10, and then the shield cover 30 is moved rearward to cover the housing 10. Here, as the shield cover 30 is provided with a plurality of protrusions 32*a* which extend rearward from the rear end of the lower covering surface 32 of the shield cover 30, when the shield cover 30 is moved to cover the insulative housing 10, these protrusions 32*a* enter the bores 18 of the housing 10 to fix the shield cover 30 to the housing 10 (refer to FIG. 5). As a result, the through holes 36 of the shield cover 30 meet the insertion openings 11*a* of the insulative housing 10, respectively. In this condition, each insertion opening 11*a* is open outward through a corresponding through hole 36.

In the condition where the shield cover 30 is mounted on the insulative housing 10, the upper covering surface 31 and lower covering surface 32 of the shield cover 30 cover the upper and lower surface of the housing 10, respectively, and the folded portion 33 of the shield cover 30 covers the front of the housing. In addition, the engaging arm portions 34 of the shield cover 30 are positioned in the cover fixing grooves 15 of the housing. As each of the engaging arm portions 34 is bent downward, the engaging arm portions 34 cover and fit the cover fixing grooves 15 of the housing 10 and fix the shield cover 30 on the housing 10. When the shield cover 30 is fixed on the insulative housing 10, the contact tabs 35 of the upper covering surface 31 of the shield cover 30 come into contact with the binding plates 55. As a result, the shielding layers 53 of the coaxial cables 50 are electrically connected to the shield cover 30.

When this shielded connector is engaged with a matable connector, the shield cover 30 meets a shielding member of the matable connector, which member is electrically grounded. As a result, the shield cover 30 is electrically grounded and provides a shield effect which prevents any electrical noise from entering the shielded connector and vice versa.

While the shielded connector is being brought into engagement with the matable connector, the male contacts 80 of the matable connector are inserted through the insertion openings 11*a* of the insulative housing 10 into the contact insertion slots 11 of the housing 10 in the direction indicated by arrow A2 in FIGS. 4 and 10. By the insertion of the male contacts 80, the resilient arm portion 25 of each female contact 20 is deformed elastically in the direction indicated by arrow A1 in FIG. 10 to receive a corresponding male contact 80 in a space between the base portion 21 and the resilient arm portion 25 of the female contact 20. As a result, the male contacts 80 are bound and fixed between the base portions 21 and the resilient arm portions 25 of the female contacts 20, respectively, so the male contacts 80 are connected electrically with the female contacts 20. In this electrical connection, the male contacts 80 extend through the through holes 36 provided at the folded portion 33 of the shield cover 30, so this arrangement is effective in preventing crosstalk among the male contacts 80.

Figure 11:
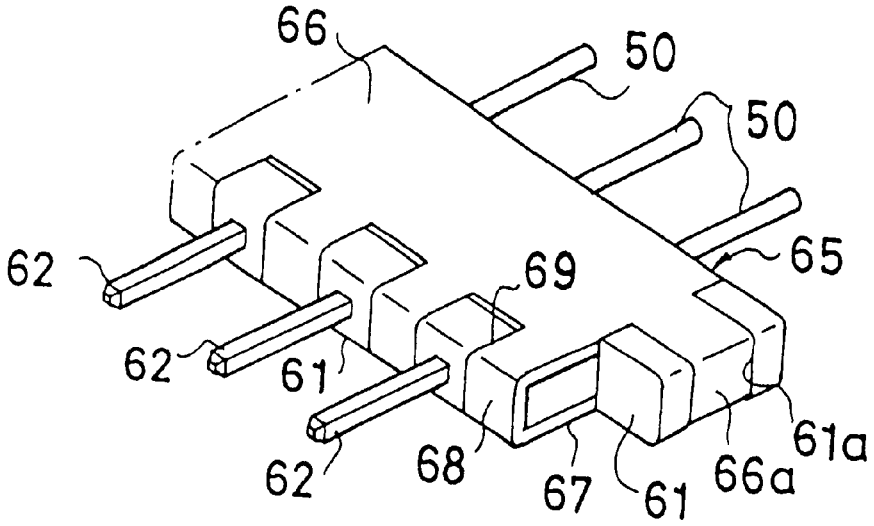
FIG. 11 is a perspective view of another embodiment of shielded connector according to the present invention.
Figure 12:
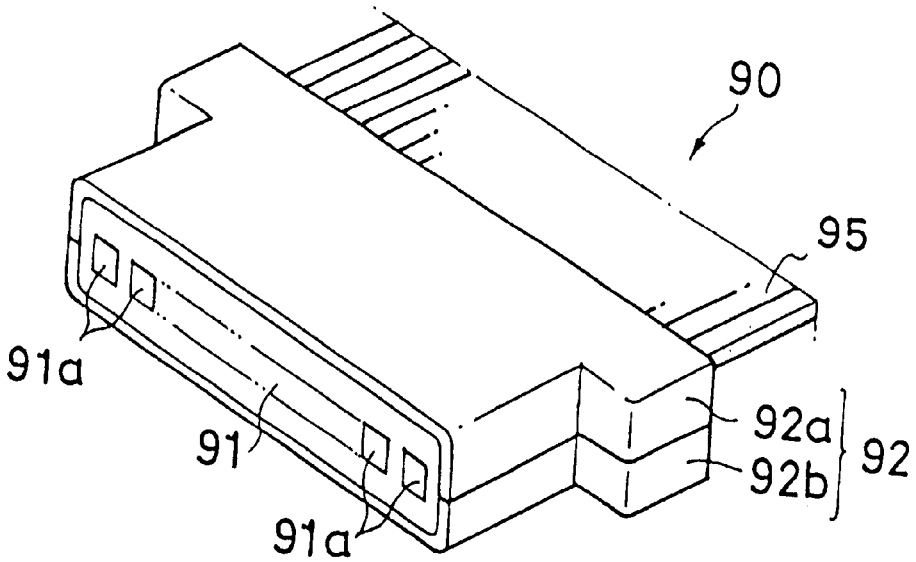
Fig. 12 PRIOR ART
FIG. 12 is a perspective view of a prior-art shielded connector.

In the above embodiment, the shielded connector according to the present invention is described from a viewpoint of the use of female contacts 20. However, a shielded connector can be constructed also with male contacts. FIG. 11 shows such a shielded connector, which includes a plurality of male contacts in an electrically insulative housing 61. These male contacts are aligned in a row in the width direction, and the contact portions 62 of the male contacts extrude forward out of the insulative housing 61, on which a shield cover 65 is mounted. In addition, the coaxial cables 50, each of which is soldered to a corresponding male contact in the insulative housing 61, extend rearward.

The shield cover 65 is formed of a metal plate and bent in a "U" figure, comprising an upper covering surface 66, a lower covering surface 67 and a folded portion 68. The right and left ends of the upper covering surface 66 extend laterally forming engaging arm portions 66*a,* which are bent over the cover fixing grooves 61*a* of the insulative housing 61 to fix the shield cover 65 on the insulative housing 61. As a plurality of through holes 69 are provided at the folded portion 68 of the shield cover 65, when the shield cover 65 is mounted on the insulative housing 61, the contact portions 62 of the male contacts extrude forward through the through holes 69 of the shield cover 65.

In the same way as the above described shielded connector with female contacts, when this shielded connector is engaged with a matable connector, the shield cover 65 meets a shielding member of the matable connector, which member is electrically grounded. As a result, the shield cover 65 is electrically grounded and provides a shield effect which prevents the transmission of any electrical noise. When the shielded connector is brought into engagement with the matable connector, the contact portions 62 of the male contacts enter the matable connector and engage with the female contacts of the matable connector, respectively. In this electrical connection, the contact portions 62 of the male contacts extend through the through holes 69, which are provided at the folded portion 68 of the shield cover 65. Therefore, this arrangement is effective in preventing any crosstalk which may occur among the contact portions 62.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shielded connector comprising a first series of contacts and a shield member, said contacts being aligned and retained in a row extending in a right and left direction in an electrically insulative housing, and said shield member being mounted over an exterior of said insulative housing; wherein:

said contacts are to be engaged with corresponding contacts of a second series of contacts of a matable connector at a front, mating face of said insulative housing for electrical connection and said insulative housing is formed with a row of individual apertures opening to the front mating face for admitting respective contacts of one series of contacts;

said shield member is formed in one piece of an electrically conductive plate and bent in a "U" figure and is mounted on said insulative housing covering upper and lower surfaces and a front mating face of said insulative housing; and said shield member is provided with a row of through holes at a front thereof corresponding to a base of the "U" figure, which meets said front mating face of said insulative housing when said shield member is mounted on said insulative housing, such that individual through holes of the shield member are in registration with respective apertures with portions of shield material extending between adjacent apertures and said contacts are engageable with said corresponding contacts of said matable connector through said through holes.

2. The shielded connector set forth in claim 1, wherein: said contacts which are aligned and retained in a row extending in a right and left direction in said insulative housing are female contacts while said corresponding contacts of said matable connector are male contacts which engage with said female contacts, respectively.

3. A shielded connector comprising a plurality of contacts and a shield member, said contacts being aligned and retained in a row extending in a right and left direction in an electrically insulative housing, and said shield member being mounted over an exterior of said insulative housing; wherein: said contacts are to be engaged with corresponding contacts of a matable connector at a front of said insulative housing for electrical connection; said shield member is formed of an electrically conductive plate and bent in a "U" figure and is mounted on said insulative housing, covering upper and lower surfaces and a front surface of said insulative housing; and said shield member is provided with a plurality of through holes at a front thereof, which meets said front surface of said insulative housing when said shield member is mounted on said insulative housing, such that said contacts are engaged with said corresponding contacts of said matable connector through said through holes, wherein:

said contacts which are aligned and retained in a row extending in a right and left direction in said insulative housing are male contacts while said corresponding contacts of said matable connector are female contacts which engage with said male contacts, respectively;

said male contacts extrude forward at said front of said insulative housing, such that when said shielded connector is engaged with said matable connector, said male contacts enter said female contacts of said matable connector for electrical connection; and when said shield member is mounted on said insulative housing, said through holes of said shield member are positioned where said male contacts extrude from said insulative housing at said front thereof.

4. The shielded connector set forth in claim 1, wherein: for mounting said shield member onto said insulative housing, a mouth of the channel is faced to said front of said insulative housing, and then said shield member is moved rearward to cover said insulative housing extending rearward from said front.

5. A shielded connector comprising a plurality of contacts and a shield member, said contacts being aligned and retained in a row extending in a right and left direction in an electrically insulative housing, and said shield member being mounted over an exterior of said insulative housing; wherein: said contacts are to be engaged with corresponding contacts of a matable connector at a front of said insulative housing for electrical connection; said shield member is formed of an electrically conductive plate and bent in a "U" figure and is mounted on said insulative housing, covering upper and lower surfaces and a front surface of said insulative housing; and said shield member is provided with a plurality of through holes at a front thereof, which meets said front surface of said insulative housing when said shield member is mounted on said insulative housing, such that said contacts are engaged with said corresponding contacts of said matable connector through said through holes, wherein:

said shield member is formed of a metal plate and bent in a "U" figure, comprising an upper covering surface, a lower covering surface and a folded portion, and said through holes are provided in said folded portion, and said shield member is provided with engaging arm portions at lateral ends of said upper covering surface; and when said shield member is mounted on said insulative housing, covering said upper and lower surfaces and said front surface thereof, said engaging arm portions are bent to cover lateral ends of said insulative housing, thereby fixing said shield member on said insulative housing.

6. A shielded connector according to claim 1, wherein the insulating housing is a single piece.

* * * * *